US007689135B2

(12) United States Patent
Tanaka

(10) Patent No.: US 7,689,135 B2
(45) Date of Patent: Mar. 30, 2010

(54) IMAGE FORMING APPARATUS WITH A DRIVE MOTOR THAT CAN ROTATE A ROTARY DEVELOPING UNIT

(75) Inventor: Hiroshi Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 547 days.

(21) Appl. No.: 11/676,129

(22) Filed: Feb. 16, 2007

(65) Prior Publication Data

US 2007/0196134 A1 Aug. 23, 2007

(30) Foreign Application Priority Data

Feb. 20, 2006 (JP) ..... 2006-041995

(51) Int. Cl.
*G03G 15/00* (2006.01)
*G03G 15/08* (2006.01)

(52) U.S. Cl. ..... 399/13; 399/27; 399/227

(58) Field of Classification Search ..... 399/12, 399/13, 27, 227
See application file for complete search history.

(56) References Cited

U.S. PATENT DOCUMENTS 7,123,863 B2 * 10/2006 Yamada et al. ..... 399/227
7,187,891 B2 * 3/2007 Tanaka ..... 399/227
7,444,102 B2 * 10/2008 Kishigami ..... 399/227

FOREIGN PATENT DOCUMENTS

JP 2004-109321 4/2004

* cited by examiner

*Primary Examiner*—William J Royer
(74) *Attorney, Agent, or Firm*—Hogan & Hartson LLP

(57) ABSTRACT

An image forming apparatus, having: a rotary developing unit, to and from which a plurality of developing cartridges storing developers are attached and detached and which moves one of the attached developing cartridges to a developing position by being rotated around a rotation axis; a drive motor that rotates the rotary developing unit; and a controller that controls a torque of the drive motor in response to a condition of the developing cartridges to be attached to the rotary developing unit or a condition of the rotary developing unit.

4 Claims, 8 Drawing Sheets

IMAGE FORMING APPARATUS WITH A DRIVE MOTOR THAT CAN ROTATE A ROTARY DEVELOPING UNIT

CROSS-REFERENCES TO RELATED APPLICATIONS

The entire disclosure of Japanese Patent Application No. 2006-41995, filed on Feb. 20, 2006, is expressly incorporated by reference herein.

BACKGROUND

1. Technical Field

The present invention relates to a control technology of a rotary drive motor equipped in an image forming apparatus.

2. Related Art

There has been known an image forming apparatus that forms a full-color polychromatic image by forming an electrostatic latent image on a charged photoconductor, then rotating a rotary whose rotation axis is disposed with a plurality of developing cartridges (so-called "toner cartridges") storing color toners for respective colors for color printing, and forming a toner image on the photoconductor by sequentially switching developing positions of the rotary (so-called "four-cycle system"). Such an image forming apparatus of the four-cycle system is disclosed in, for example, JP-A-2004-109321.

Incidentally, in the existing image forming apparatuses of the four-cycle system, the drive motor of the rotary is driven at a constant torque. At this moment, in the case where the torque of the drive motor is conformed to the maximum torque required for rotating the rotary, minute vibration occurs when the required torque is small, causing large operation noise and thereby bringing discomfort to a user. On the other hand, if the torque is reduced in order to minimize the noise, loss of synchronism occurs when the required torque is large, whereby development cannot be performed because a rotary developing unit cannot be rotated to the developing position, causing image degradation.

For this reason, in order to reduce the noise caused when rotating the rotary, there has been adopted a control method for slowly rotating the rotary after conforming the torque of the drive motor to the maximum torque required for rotating the rotary. According to this control method, the occurrence of loss of synchronism can be prevented and at the same time the noise can be reduced. However, it takes a long time to switch the developing cartridges, slowing the print speed and causing another stress to the user.

SUMMARY

This invention is contrived in view of such circumstances, and an advantage of some aspects of the invention is to provide an image forming apparatus that is capable of preventing the occurrence of loss of synchronism and at the same time reducing the noise without reducing the print speed.

In order to solve the above problems, the image forming apparatus according to the invention has: a rotary developing unit, to and from which a plurality of developing cartridges storing developers are attached and detached and which moves one of the attached developing cartridges to a developing position by being rotated around a rotation axis; a drive motor that rotates the rotary developing unit; and a controller that controls a torque of the drive motor in response to a condition of the developing cartridges to be attached to the rotary developing unit or a condition of the rotary developing unit.

According to an aspect of the invention, in response to the condition of the developing cartridges to be attached to the rotary developing unit or the condition of the rotary developing unit, the torque of the drive motor is variably controlled at sufficient torque required for rotating the rotary developing unit, thus the image forming apparatus that is capable of preventing the occurrence of loss of synchronism and at the same time reducing the noise without reducing the print speed can be provided.

Here, it is preferred that the torque of the drive motor be determined according to the amount of current to be fed to the drive motor, and that the controller control the torque of the drive motor, by controlling the amount of the current to be fed to the drive motor, in response to the condition of the developing cartridges or the condition of the rotary developing unit According to another aspect of the invention, the torque of the drive motor can be variably controlled by the amount of the current to be fed to the drive motor.

Furthermore, preferably, the condition of the developing cartridges to be attached to the rotary developing unit or the condition of the rotary developing unit includes at least one of; an attachment condition indicating the number of the developing cartridges attached to the rotary developing unit and the place of attachment of the developing cartridges; a residual amount of the developers of the developing cartridges attached to the rotary developing unit; a phase indicating the position of rotation of the rotary developing unit; and a rotational acceleration of the rotary developing unit. According to a further aspect of the invention, the torque of the drive motor can be variably controlled in accordance with the attachment condition and the like of the developing cartridges.

Moreover, the condition of the developing cartridges to be attached to the rotary developing unit or the condition of the rotary developing unit preferably includes all conditions, i.e. an attachment condition indicating the number of developing cartridges attached to the rotary developing unit and the place of attachment of the developing cartridges; a residual amount of the developers of the developing cartridges attached to the rotary developing unit; a phase indicating the position of rotation of the rotary developing unit; and a rotational acceleration of the rotary developing unit. According to yet another aspect of the invention, the torque of the drive motor can be variably controlled more precisely in accordance with the attachment condition and the like of the developing cartridges.

Here, preferably, the controller obtains a reference current amount on the basis of the attachment condition and the developer residual amount, obtains an adjustment factor on the basis of the phase, obtains a compensation factor on the basis of the rotational acceleration, calculates the amount of current by adding the compensation factor to the result obtained by multiplying the reference current amount by the adjustment factor, and controls the drive motor by means of the calculated current amount. According to a still further aspect of the invention, the amount of current to be fed to the drive motor to obtain a sufficient required torque can be easily computed by using the adjustment factor and the like.

Furthermore the torque control method of the image forming apparatus according to an aspect of the invention is a method of controlling a torque of a drive motor of the image forming apparatus that has: a rotary developing unit; to and from which a plurality of developing cartridges storing developers are attached and detached and which moves one of the attached developing cartridges to a developing position by being rotated around a rotation axis; the drive motor that rotates the rotary developing unit; and a controller that controls the torque of the drive motor, wherein the method has: a step in which the controller acquires a result of detecting a condition of the developing cartridges to be attached to the rotary developing unit or a condition of the rotary developing unit; and a step in which the controller controls the torque of the drive motor in response to the acquired detection result.

According to an aspect of the invention, the invention can provide the control method of the image forming apparatus having the rotary developing unit and the like, the method being capable of preventing the occurrence of loss of synchronism and at the same time reducing the noise without reducing the print speed, by variably controlling the torque of the drive motor at sufficient torque required for rotating the rotary developing unit, in response to the condition of the developing cartridges to be attached to the rotary developing unit or the condition of the rotary developing unit.

A program according to an aspect of the invention causes a computer to execute each of the steps of the torque control method of the image forming apparatus of the invention. This program of the invention can be downloaded via various storage media such as a CD-ROM or other optical disks, a magnetic disk or semiconductor memory, or via a communication network or the like, and thereby installed or downloaded into the computer.

It should be noted that the "phase" in the invention indicates how much (how many degrees) the rotary developing unit has been rotated from a predetermined reference position thereof.

BRIEF DESCRIPTION OF THE DRAWINGS

Hereinafter, embodiments of the image forming apparatus will be described with reference to the drawings.

DESCRIPTION OF EXEMPLARY EMBODIMENTS

Figure 1:
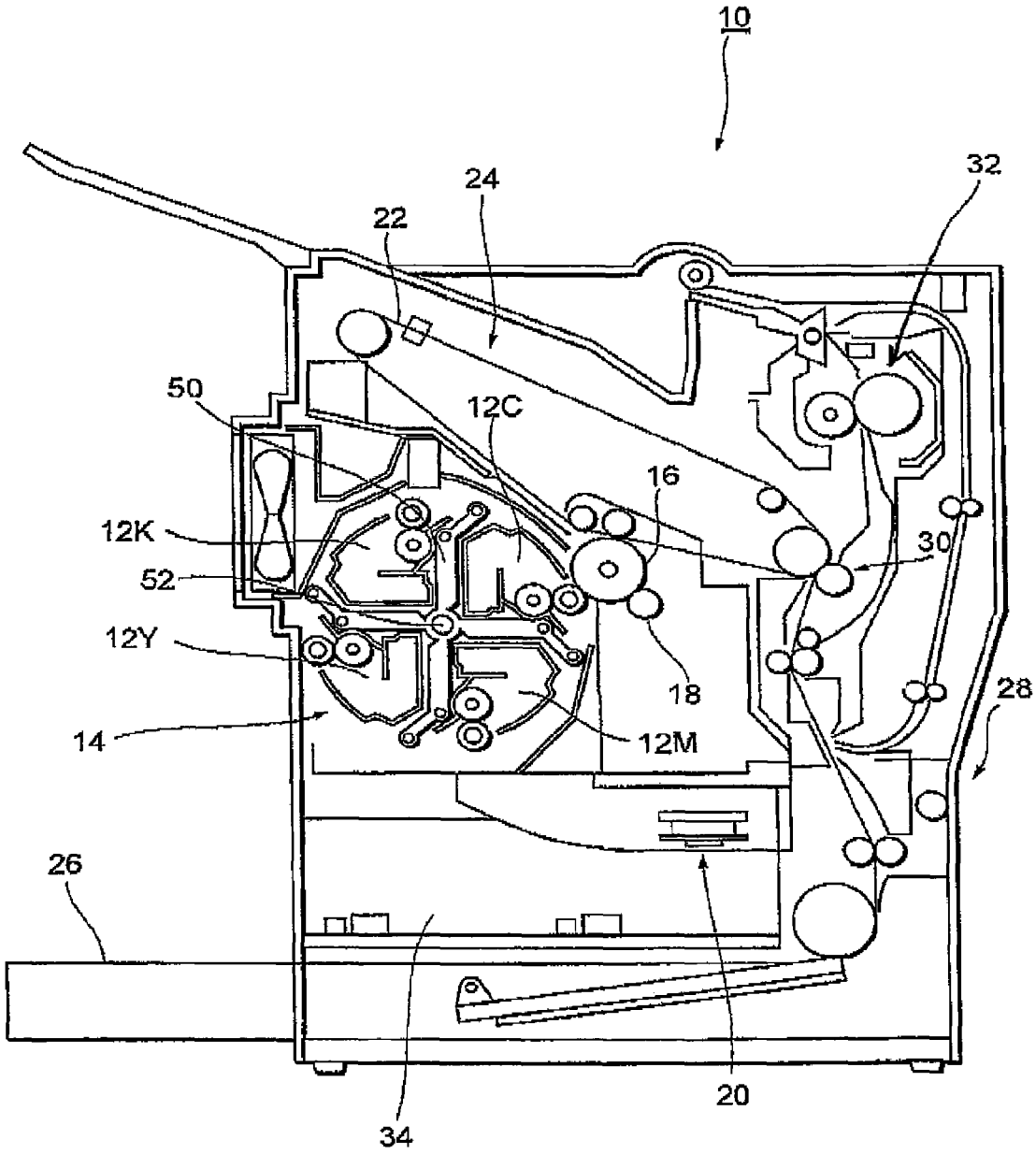
FIG. 1 is a longitudinal side view showing a schematic configuration of a color laser printer 10.

FIG. 1 is a longitudinal side view of a schematic configuration of a color laser printer 10, which is an embodiment of the image forming apparatus equipped with the developing cartridges according to the invention. The color laser printer 10 of the present embodiment is configured as an image forming apparatus of full-color electrophotographic type in which a single photoconductor system and an intermediate transfer system are adopted, and has a rotary developing unit 14 for holding a developing cartridge 12 (12C, 12M, 12Y, 12K) which is a developing section, as shown in the figure.

Furthermore, the color laser printer 10 has a photoconductor 16 that functions as an image supporting body, a charging roller 18 that charges the photoconductor 16 to a uniform electric potential (−700V, for example), an exposure unit 20 that irradiates the charged photoconductor 16 with a laser to form an electrostatic latent image of an image of each color obtained by separating four colors of cyan (C), magenta (M), yellow (Y) and black (K), a primary transfer unit 24 that places, on a transfer belt 22, an obtained toner image of each color that is developed on the photoconductor 16, and transfers each toner image to form a color toner image, a conveying unit 28 that conveys a sheet (recording medium) from a sheet cassette 26, a secondary transfer unit 30 that transfers the color toner image formed on the transfer belt 22 to the conveyed sheet, a fixing unit 32 that fixes the color toner image, which has been transferred onto the sheet, to the sheet and discharges the sheet, and a controller 34 that controls the entire operation of the color laser printer 10.

The rotary developing unit 14 is provided with members such as a supporting frame 50 that rotates freely around a rotation axis 52, a rotary drive section, and the like. The rotary developing unit 14 further has a cyan developing cartridge 12C, magenta developing cartridge 12M, yellow developing cartridge 12Y and black developing cartridge 12K that are configured detachably with respect to the supporting frame 50 and contain toners of the respective colors (developers) These developing cartridges 12C, 12M, 12Y and 12K are replaceably attached as so-called toner cartridges.

By determining the positions of the developing cartridges 12C, 12M, 12Y and 12K in a circumferential direction of the rotary developing unit 14, the developing cartridges 12C, 12M, 12Y and 12K are selectively placed adjacent to the photoconductor 16 so that the toners can be supplied to the surface of the photoconductor 16. In this manner, the electrostatic latent image on the photoconductor 16 is developed in a selected toner color. Specifically, the four developing cartridges 12C, 12M, 12Y and 12K are successively placed to face the photoconductor 16 by turning the rotary developing unit 14 90 degrees around the rotation axis 52 four times, and then a toner image is developed in each color onto the photoconductor 16 four times.

The toner image in each color that is developed on the photoconductor 16 in the above mentioned manner is placed on the transfer belt 22 of the primary transfer unit 24 and then transferred. The toner image is then transferred onto a sheet conveyed from the transfer belt 22, by the secondary transfer unit 30, and fixed to the sheet by the fixing unit 32. Thereafter, the sheet with the toner image fixed thereon is discharged to the color laser printer 10.

It should be noted that the charging roller 18, exposure unit 20, transfer belt 22, secondary transfer unit 30 and the like are the same as those of an ordinary color laser printer or color copying machine, thus detailed explanations thereof are omitted herein.

Figure 2:
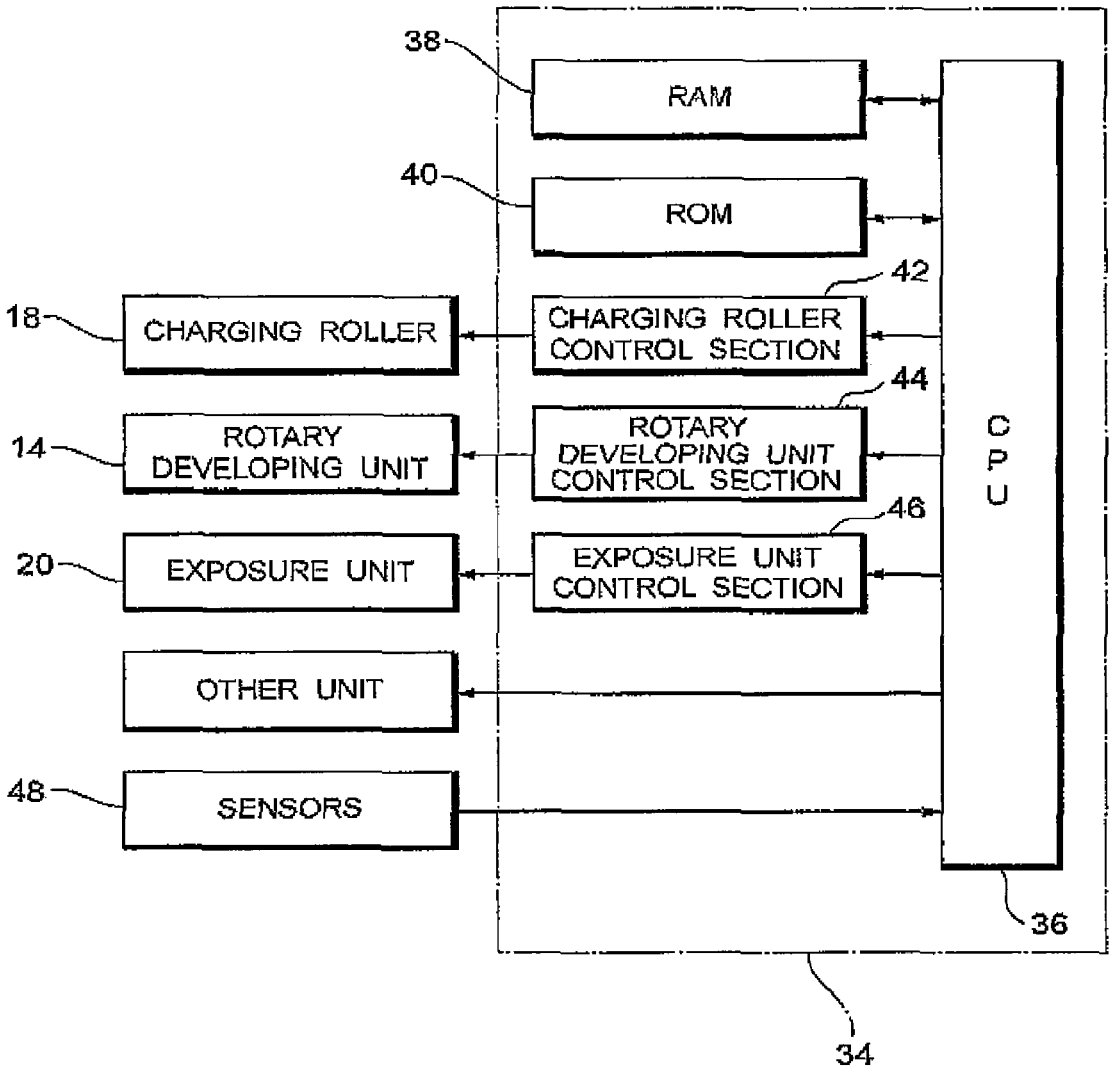
FIG. 2 is a block diagram showing a schematic electrical configuration of a controller 34.

FIG. 2 is a block diagram showing a schematic electrical configuration of the controller 34. As shown in the figure, the controller 34 is constituted as a microprocessor mainly having a CPU 36, RAM 38 and ROM 40. Moreover, controller 34 is constituted so that detected values or other input signals (e.g. a print instruction signal and the like that are inputted by an operator) that are inputted via various sensors 42 (e.g. an optical sensor and the like that are described hereinafter) are inputted via signal lines, and is also constituted so as to control a charging potential applied to the charging roller 18, rotary drive of the rotary developing unit 14, a developing bias potential applied to the rotary developing unit 14, exposure amount of the exposure unit 20, and other operations of the other components of the color laser printer 10 by means of a charging roller control section 42, a rotary developing unit control section 44, an exposure unit control section 46 and the like on the basis of the inputted signals.

Figure 3:
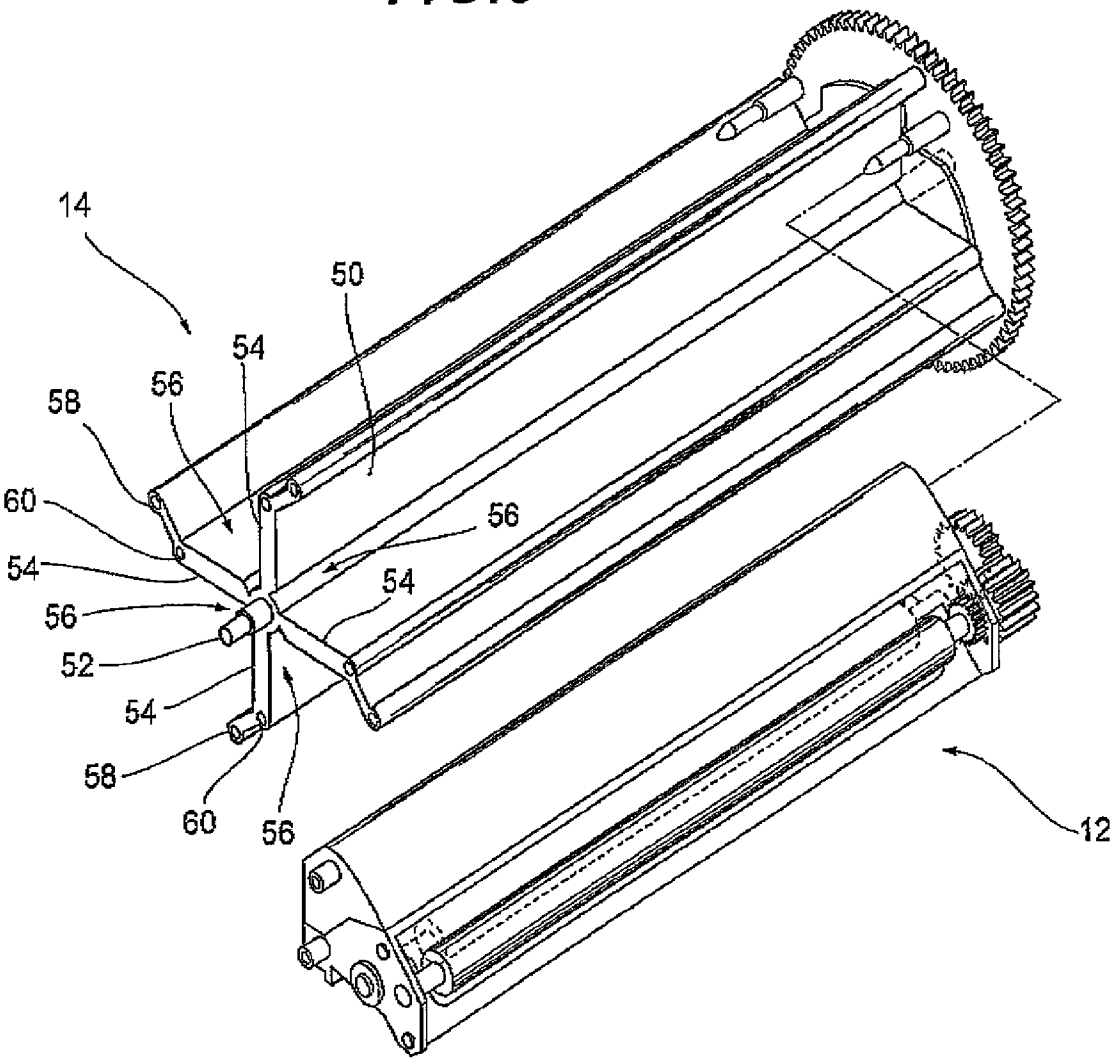
FIG. 3 is a perspective view showing a substantial part of a rotary developing unit 14.

FIG. 3 is a perspective view showing a substantial part of the rotary developing unit 14. As shown in the figure, the rotary developing unit 14 has the rotation axis 52 at the center thereof, and the supporting frame 50 is fixedly provided on the rotation axis 52, the supporting frame 50 being constituted by four frame elements 54 that are arranged at intervals of 90 degrees around the rotation axis 52. Storage sections 56 are formed between adjacent frame elements 54 so that the abovementioned four developing cartridges 12C, 12M, 12Y and 12K are stored (attached) into the storage sections 56 respectively.

An end injection section 58 is formed on the end of each of the frame elements 54 constituting the supporting frame 50, and an internal injection section 60 is formed inside each end injection section 58. When each developing cartridge 12 is attached to the supporting frame 50, the developing cartridge 12 is caused to slide in a longitudinal direction while disposed inside the storage section 56, and two injection projection sections (not shown), which are end section covers provided in a left-side end section (the end sections on the side where the end injection section 58 is formed) of the development cartridge 12, are inserted into the end injection section 58 and the internal injection section 60 respectively. Accordingly, the development cartridge 12 is fixed to the supporting frame 50. It should be noted that FIG. 3 shows only the development cartridge 12C for simplification.

The rotary drive section (not shown) that is constituted by a rotary drive motor is connected to the rotation axis 52 via a clutch. The supporting frame 50 is rotated by driving this rotary drive motor, and one of the four developing cartridges 12C, 12M, 12Y and 12K is selectively positioned at a developing position (the position of the developing cartridge 12C in FIG. 1) so as to face the photoconductor 16.

This rotary drive motor is a stepping motor driven at a constant voltage, and can determine the phase of the rotary developing unit 14 on the basis of the number of pulses that have been applied to the stepping motor since the start of rotation of the stepping motor from its predetermined home position. Moreover, the rotary drive motor can perform rough proportional control on a torque on the basis of the amount of current to be supplied to this motor. Specifically, in order to obtain a required torque to rotary drive the rotary developing unit 14, the rotary drive motor needs to feed current corresponding to the required torque. Here, loss of synchronism occurs if the amount of current is insufficient, thus the rotary developing unit 14 cannot be moved to a desired position. Moreover, when excessive current is fed unnecessarily, minute vibration and noise occur.

The developing cartridges 12C, 12M, 12Y and 12K that are supported by the supporting frame 50 all have the same configuration. Therefore, the developing cartridges 12C, 12M, 12Y and 12K are generally referred to as "developing cartridge 12" hereinafter.

Next, the current control on the rotary drive section (rotary drive motor) that is performed by the controller 34 is described. In this embodiment, in order to obtain a required and sufficient torque, the controller 34 adjusts the amount of current I (X, θ, W, a) to be fed to the rotary drive motor, in accordance with (1) the attachment condition X of the developing cartridge 12, (2) the phase θ of the rotary developing unit 14, (3) toner residual amount W in the developing cartridge 12, and (4) acceleration a of the rotary developing unit 14. These conditions are described in detail hereinafter.

Attachment Condition of Developing Cartridge

The total weight (weight balance) of the rotary developing unit 14 deflects in accordance with the attachment condition of the developing cartridge 12. As this deflection of the total weight separates from the rotation axis 52, that is, as the deflected weight increases, a large torque becomes necessary when rotating the rotary developing unit 14. In addition, the larger the entire weight of the rotary developing unit 14, the larger the inertia moment thereof, thus the required torque becomes large.

Figure 4:
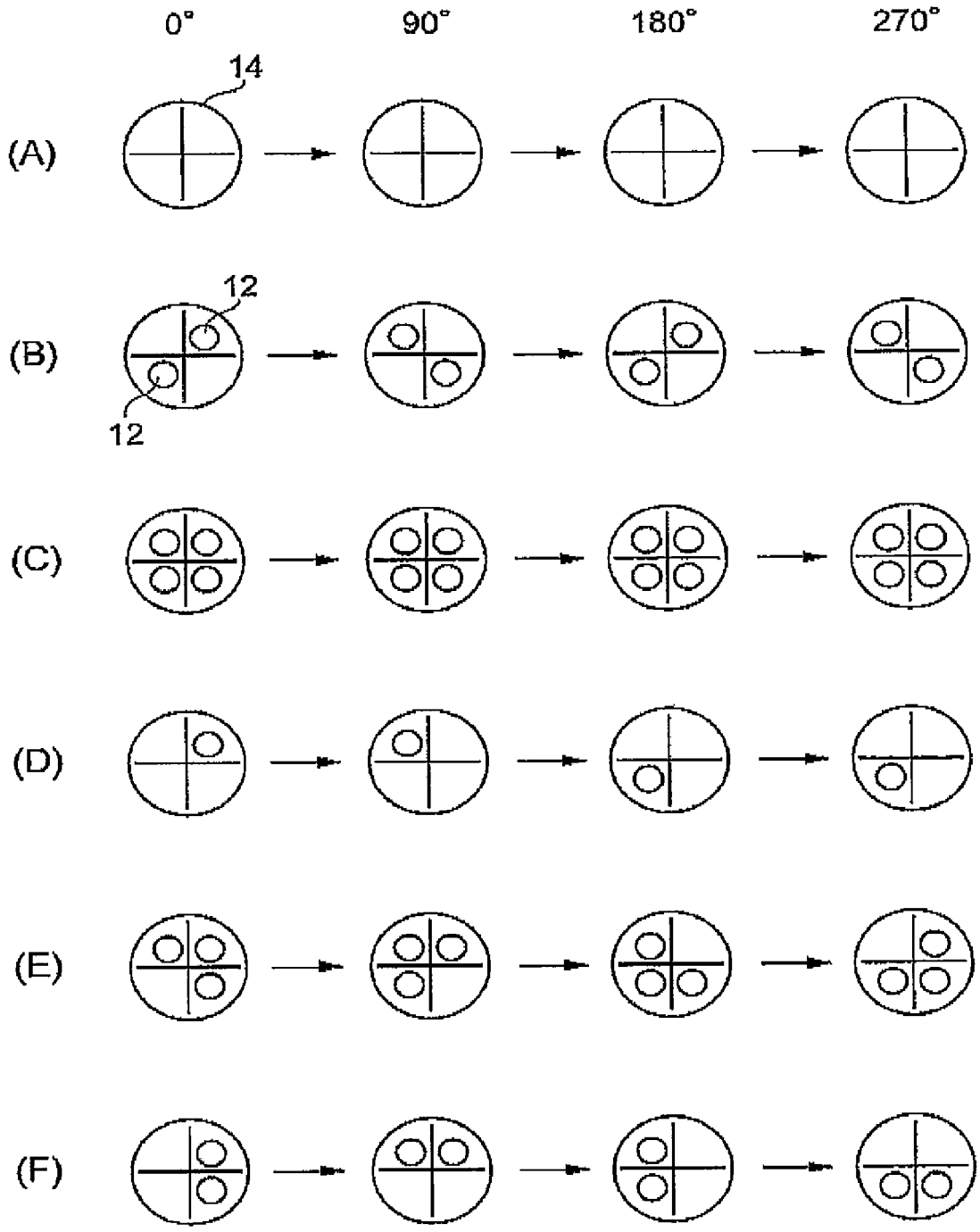
FIG. 4 shows an attachment condition X and a phase θ.

FIG. 4 shows the attachment condition of the developing cartridge 12 and the phase of the rotary developing unit 14 according to this embodiment. In FIG. 4, a graphic form 14 is a symbol of the rotary developing unit 14, and a circle 12 is a symbol of the developing cartridge 12 attached to the rotary developing unit 14. Furthermore, a fan-shaped area on an upper tight part of the graphic form 14 indicates the position of the developing cartridge 12C in FIG. 1 (the position facing the photoconductor 16). Therefore, the leftmost figure of FIG. 4A shows a state in which no developing cartridge 12 is attached to the rotary developing unit 14, and the leftmost figure of FIG. 4B shows a state in which the developing cartridge 12 is attached at the positions in FIG. 1 of the developing cartridges 12C and 12Y. It should be noted in FIG. 4 that the figures other than the abovementioned two figures are not applied with any reference numerals.

As described above, FIG. 4A shows a state in which no developing cartridge 12 is attached, FIG. 4B shows a state in which only two developing cartridges facing each other are attached, FIG. 4C shows a state in which all four developing cartridges are attached, FIG. 4D shows a state in which only one developing cartridge is attached, FIG. 4F shows a state in which three developing cartridges are attached, and FIG. 4F shows a state in which only two adjacent developing cartridges are attached.

As in this embodiment, in the case of a so-called four-cycle type rotary developing unit 14 that is capable of storing four developing cartridges 12, the six patterns from FIG. 4A to FIG. 4F can be considered as the attachment conditions of the developing cartridges 12. In these six patterns, the deflected total weight and the like increase from FIG. 4A toward FIG. 4F successively (i.e. toward the lower figures of FIG. 4), thus the maximum torque required for driving the rotary drive motor increases. Therefore, in order to obtain a required sufficient torque, it is necessary to increase the maximum value of current to be fed to the rotary drive motor as the deflected total weight and the like increase from FIG. 4A toward FIG. 4F.

Phase of Rotary Developing Unit

Although the rotary developing unit 14 is rotary driven around the rotation axis 52, the moment of the rotational movement thereof changes in accordance with the position of the developing cartridge 12 attached to the rotary developing unit 14 in this rotation, thus the required torque also changes. Therefore, in order to obtain the required sufficient torque, it is necessary to fluctuate the amount of current to be fed to the rotary drive motor in accordance with the phase of the rotary developing unit. Specifically, a small amount of current may be fed if the rotary developing unit 14 is at a position phase) where the rotation is accelerated by the weight of the developing cartridge 12, while a large amount of current may be fed if the rotation is decelerated by the weight of the developing cartridge 12.

Also, in this embodiment, a reference current amount I (X, θ), which is the basis for calculating the amount of current to be fed to the rotary drive motor, is determined on the basis of the attachment condition X of the developing cartridge 12 and the phase θ of the rotary developing unit 14. It should be noted here that the phase is determined as shown in FIG. 4, for each attachment condition of the developing cartridge 12.

Figure 5:
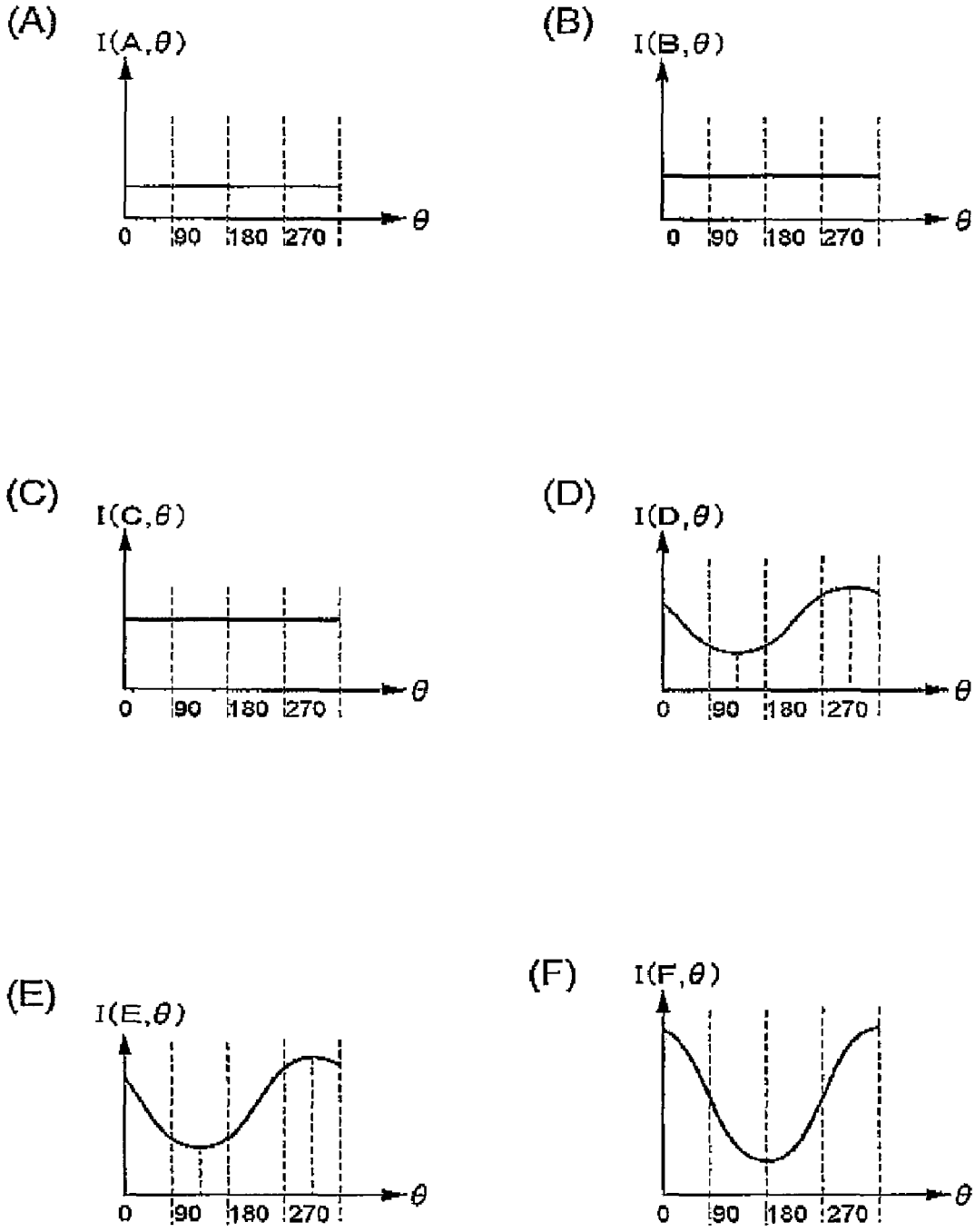
FIG. 5 shows relationships among the attachment condition X, the phase θ and a reference current amount I (X, θ)

FIG. 5 shows a relationship between the phase θ and the reference current amount I (X, θ) for each attachment condition X of the developing cartridge 12. In FIG. 5, each horizontal axis shows the phase θ of the rotary developing unit 14, and each vertical axis shows the reference current amount I (X, θ). FIG. 5A through FIG. 5F correspond to the six patterns of FIG. 4A through FIG. 4F, wherein FIG. 5A shows a relationship between the phase θ and a reference current amount I (A, θ) in the case where no developing cartridge 12 is attached. Similarly, FIG. 5B shows the case there only two developing cartridges facing each other are attached, FIG. 5C shows the case where all four developing cartridges are attached, FIG. 5D shows the case where only one developing cartridge is attached, FIG. 5E shows the case where three developing cartridges are attached, and FIG. 5F shows the case where only two adjacent developing cartridges are attached.

Residual Amount of Toner in Developing Cartridge

The weight of the developing cartridge 12 fluctuates in accordance with the toner residual amount. Therefore, the deflected total weight or inertia moment of the rotary developing Unit 14 fluctuates in response to the toner residual amount in the attached developing cartridge 12, and the amount of the torque required for rotation also fluctuates. Therefore, it is preferred that the amount of current to be fed to the rotary drive motor be adjusted in response to the toner residual amount in the developing cartridge 12 attached to the rotary developing unit 14. It should be noted that the toner residual amount may be obtained in accordance with, for example, a toner count that is recorded in a storage element (not shown) provided in each developing cartridge 12.

Figure 6:
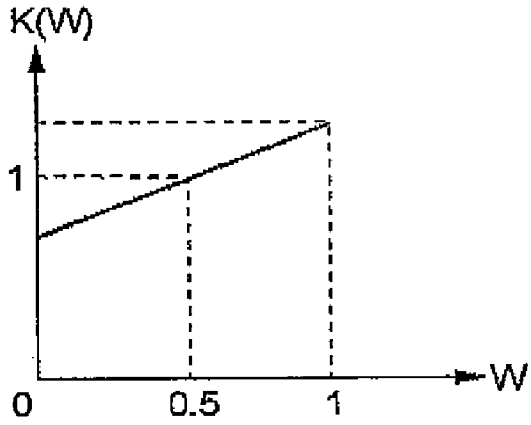
FIG. 6 shows a schematic relationship between a residual amount of toner W and an adjustment factor k(W.

FIG. 6 shows a schematic relationship between the toner residual amount W and an adjustment factor k(w) In FIG. 6, the horizontal axis shows the toner residual amount W, wherein 0 means a state in which the developing cartridges are empty, while 1 means a state in which the developing cartridges are full. The vertical axis shows the adjustment factor k(w). The adjustment factor k(W) is a factor for adjusting the degree of fluctuation of the torque in response to the toner residual amount W (i.e. the weight of the toner). It should be noted that in the case where a plurality of developing cartridges 12 are attached to the rotary developing unit 14, an average of toner residual amount can be used as the toner residual amount W.

Acceleration and Deceleration of Rotary Developing Unit

When the rotary developing unit 14 is brought from a resting state to a constant-speed rotation or from the constant-speed rotation state to the resting state, a torque for accelerating or decelerating the rotation of the rotary developing unit 14 is required. Specifically, when accelerating the rotation, a larger torque is required, thus the amount of current to be fed to the rotary drive motor may be increased by a predetermined amount. On the other hand, when decelerating the rotation, a small amount of torque is enough, thus the amount of current to be fed to the motor may be reduced by a predetermined amount.

Figure 7:
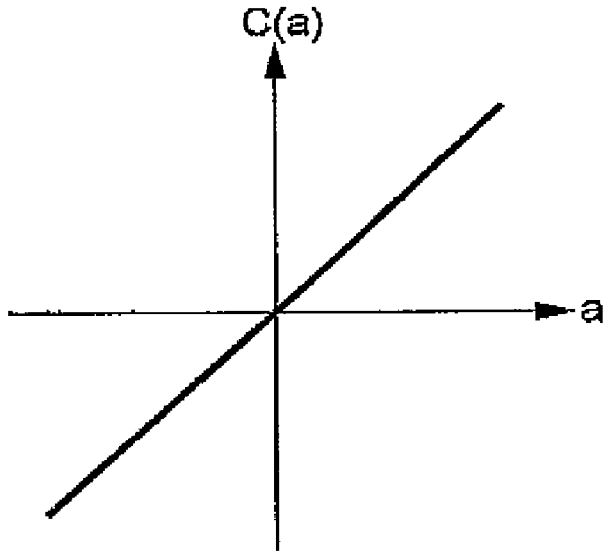
FIG. 7 shows a schematic relationship between a rotational acceleration a and a compensation factor C(a)

FIG. 7 shows a schematic relationship between a rotational acceleration a of the rotary developing unit 14 and a compensation factor C(a). In FIG. 7, the horizontal axis shows the rotational acceleration a, while the vertical axis shows the compensation factor C(a) The compensation factor C(a) is a factor for adjusting the degree of fluctuation of the torque in response to the acceleration a. It should be noted that when the acceleration a is a negative value, it means that the rotation is decelerated.

As described above, in this embodiment the amount of current I (X, θ, W, a) to be fed to the rotary drive motor is determined. At this moment, the relationship among the attachment condition X of the developing cartridge 12, the phase θ of the rotary developing unit 14 and the reference current amount I (X, θ), the relationship between the toner residual amount w and, the adjustment factor k(W), and the relationship between the rotational acceleration a of the rotary developing unit 14 and the compensation factor C(a) are stored in the ROM 40 beforehand, and the ROM 40 is referenced when controlling the drive of the rotary developing unit 14.

Control of Current fed to Rotary Drive Motor Next, a flow of control of the current to be fed to the rotary drive motor is described specifically.

Figure 8:
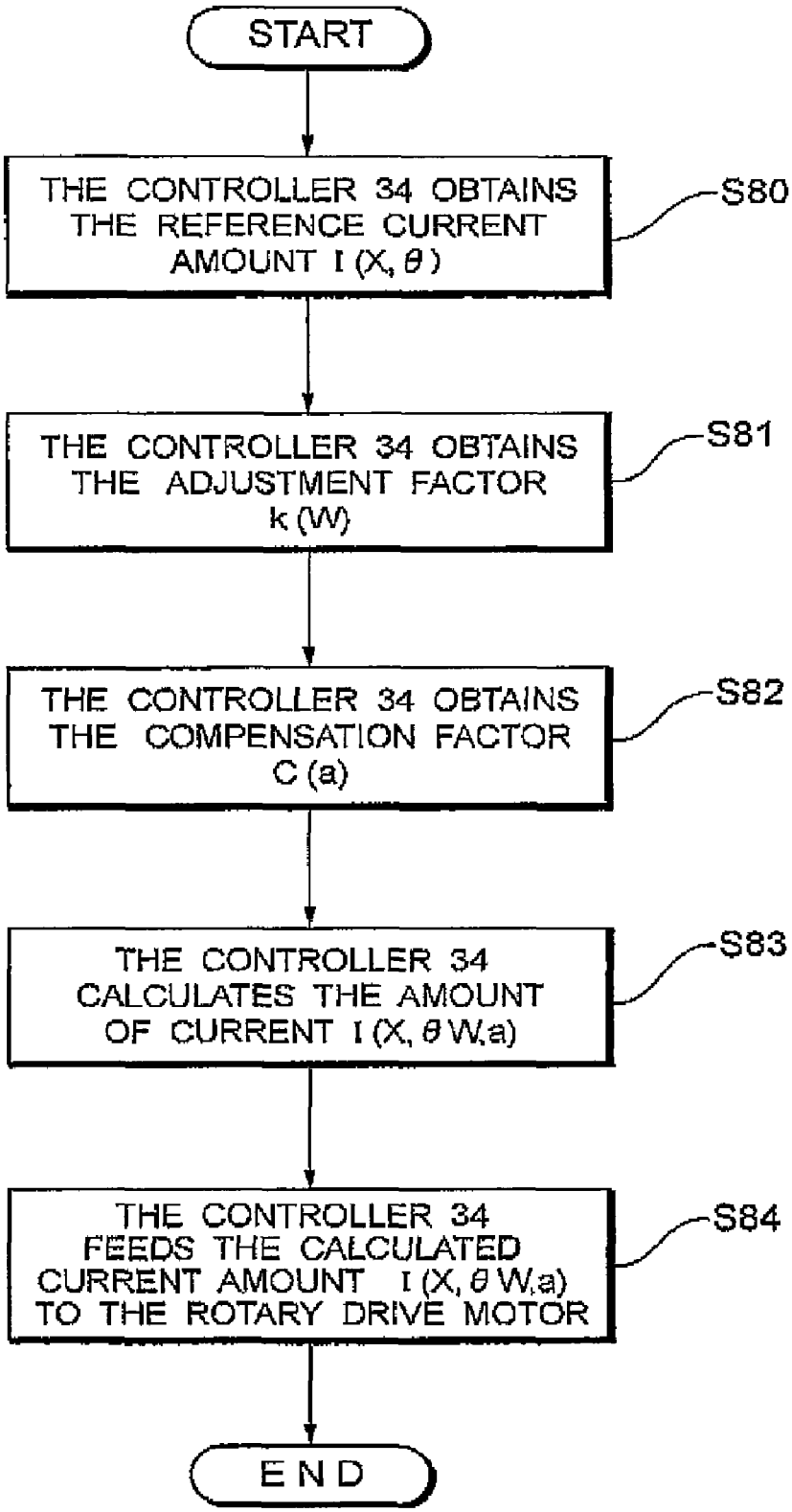
FIG. 8 shows a flow of calculation of the amount of current to be fed to a rotary drive motor.

FIG. 8 shows a flow of calculation of the amount of current to be fed to the rotary drive motor, the calculation being performed by the controller 34. First, prior to the control performed for rotating the rotary developing unit 14, the controller 34 detects the attachment condition X of the developing cartridge 12 and the phase θ of the rotary developing unit 14 to obtain the reference current amount I (X, θ) (S80) It should be noted that the controller 34 can acquire the attachment condition X of the developing cartridge 12 and the like by means of a mechanical control firmware incorporated in the controller 34.

In this embodiment, the controller 34 detects one of the conditions (A) through (F) as the attachment condition X, and at the same time detects whether the phase θ is 0 degree, 90 degrees, 180 degrees or 270 degrees at the present moment. Then, the controller 34 reads the reference current amount I (X, θ) corresponding to the detection results from the ROM 40.

Next, the controller 34 detects the toner residual amount W of the developing cartridge 12 to obtain the adjustment factor k(W) (S81) In this embodiment, the toner count is read from the storage element provided in each developing cartridge 12, and thereby the toner residual amount W is detected. In the case where a plurality of developing cartridges 12 are attached to the rotary developing unit 14, the average of the toner residual amount is obtained. Then, the adjustment factor k(W) is obtained based on the relational expressions stored in the ROM 40.

The controller 34 then obtains the compensation factor C(a) on the basis of the rotational acceleration a of the rotary developing unit 14 (S82) In the case of the four-cycle type rotary developing unit as in this embodiment, the rotary developing unit 14 is turned in the unit of 90 degrees when performing printing, and thereby the positions of the developing cartridges 12 are set. At this moment, the rotation is controlled such that the rotation is accelerated initially and then decelerated at the end. Then, the compensation factor C(a) is obtained based on the relational expressions stored in ROM 40.

Thereafter, the controller 34 calculates the amount of current I (X, θ, W, a) to be fed to the rotary drive motor (S83). Specifically, the amount of current is calculated based on the following mathematical formula (1);

$$I(X, \theta, W, a)=k(W)\times I(X, \theta)+C(a) \quad (1)$$

Finally the controller 34 feeds the calculated current amount I (X, θ, W, a) to the rotary drive motor to control the rotational drive of the rotary developing unit 14 (S84).

Figure 9:
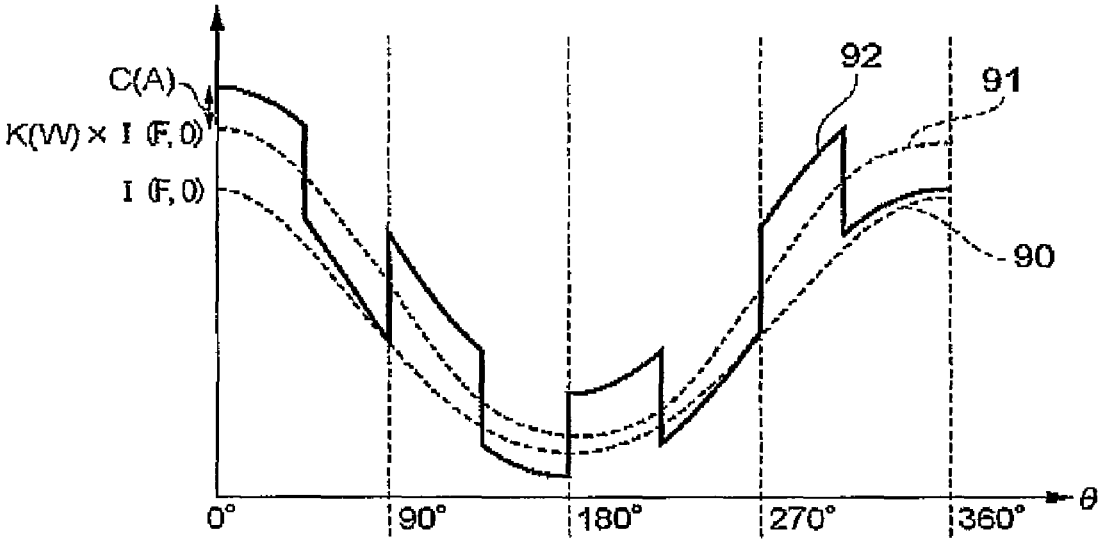
FIG. 9 shows an example of control of the current to be fed to the rotary drive motor.
Figure 10:
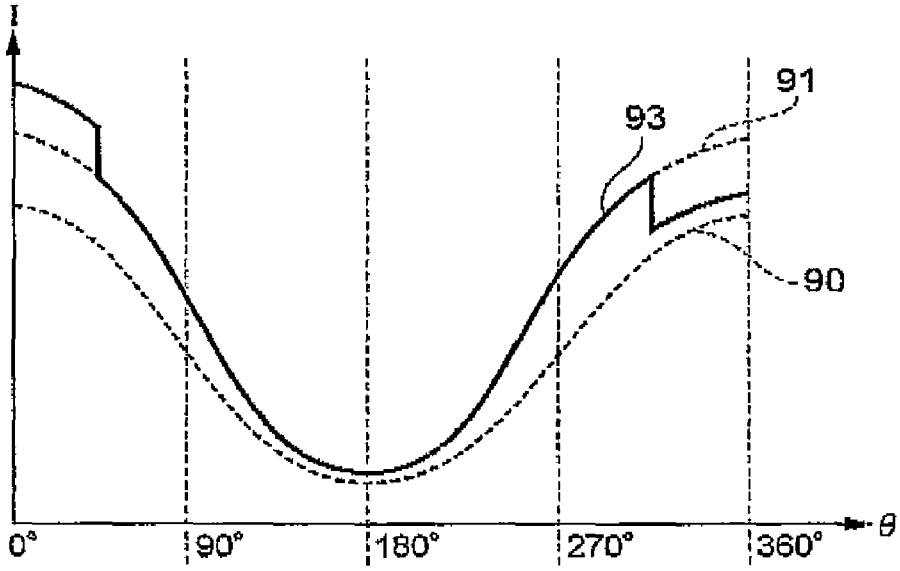
FIG. 10 shows an example of control of the current to be fed to the rotary drive motor.

FIGS. 9 and 10 show, as an example of the control of current to be fed to the rotary drive motor, the amount of current to be fed to the rotary drive motor by the controller 34 when the rotary developing unit 14 is rotated once from the 0-degree phase in a state in which only two adjacent developing cartridges 12 are attached to the rotary developing unit 14 (the state shown in FIG. 4F). In FIGS. 9 and 10, each horizontal axis shows the phase θ, while each vertical axis shows the amount of current I to be fed to the rotary drive motor.

Here, FIG. 9 shows a case where the rotary developing unit 14 is rotated once from the 0-degree phase by stopping the rotary developing unit 14 at every 90-degree phase. FIG. 10 shows a state in which the rotary developing unit 14 is stopped after rotated once from the phase 0 degree (without stopping). It should be noted that the examples shown in FIGS. 9 and 10 show a case where the rotation is accelerated in the first 45 degrees and decelerated in the last 45 degrees.

In FIGS. 9 and 10, each dashed line 90 shows a reference current amount I (F, θ) that is obtained by the attachment condition of the developing cartridge 12 ((F) in this case) and the phase θ of the rotary developing unit 14. Each dashed line 91 shows a current amount k(W)×I (F, θ) that is added with the adjustment factor k(W) determined by the toner residual amount W. In this manner, amplitude of the current amount is adjusted in accordance with the toner residual amount W, i.e. the weight.

The solid line 92 shown in FIG. 9 and the solid line 93 shown in FIG. 10 show the amount of current I (F, θ, W, a) to be fed to the rotary drive motor. Each of these current amount is obtained by adding the compensation factor C(a), which is defined by the acceleration a, to the dashed line 91 In this manner, the amount of current is adjusted in accordance with the acceleration a.

As described above, in the image forming apparatus of this embodiment, the controller 34 adjusts the amount of current to be fed to the rotary drive motor on the basis of; (1) the attachment condition of the developing cartridge 12; (2) the phase of the rotary developing unit 14; (3) the toner residual amount in the developing cartridge 12; and (4) acceleration of the rotary developing unit 14, whereby the required sufficient torque can be secured. Accordingly, loss or synchronism that is caused due to lack of torque, and minute vibration that is caused due to excess torque can be prevented, and image formation degradation of the image forming apparatus can be prevented from occurring.

It should be noted that the present invention is not limited to the above-described embodiments, and thus can be carried out in various other ways without departing from the scope of the invention. Therefore, the above-described embodiments are merely examples in all respects, and thus are not to be interpreted definitely.

For example, in this embodiment, the amount of current to be fed to the rotary drive motor is controlled by combining all elements: (1) the attachment condition of the developing cartridge 12; (2) the phase of the rotary developing unit 14; (3) the toner residual amount in the developing cartridge 12; and (4) acceleration of the rotary developing unit 14. However, the amount of current may be controlled by applying only one of the above four elements, or the amount of current may be controlled by combining any two or three elements.

Moreover, in this embodiment, the amount of current to be fed to the rotary drive motor is calculated based on the mathematical formula (1), but other calculation methods may be employed. For example, by obtaining the reference current amount I (X, θ, W) on the basis of the relationship among the three elements, i.e. the attachment condition X, phase θ, and toner residual amount W, and by calculating the amount of current by adding the compensation factor C(a) to the reference current amount I (X, θ, W), control of the current can be performed more precisely.

Here, for example, in the case of considering three cases regarding the toner residual amount W, in order to obtain the reference current amount I (E, θ, W, (W1, W2, W3)) in the case shown in FIG. 4(E), a table having a total of 4×3×3×3=108 records, which is obtained from four patterns of the phase θ (0 degree, 90 degrees, 180 degrees, 270 degrees) and three patterns of the toner residual amount W1 through W3, is stored in the ROM 40 beforehand, whereby the reference current amount can be obtained from this table.

Furthermore in this embodiment, the controller 34 determines the attachment condition of the developing cartridge 12 by means of the mechanical control firmware, but a contact-type or noncontact-type sensor for detecting the attachment condition of the developing cartridges 12 may be newly provided to detect the attachment condition using this sensor.

Also, in this embodiment, the phase of the rotary developing unit 14 is determined on the basis of the number of pulses that have been applied to the stepping motor since the start of rotation of the stepping motor from its predetermined home position, but the phase may be detected using an encoder. Moreover, for example, the rotary developing unit 14 may be provided with a screen, and a position sensor such as an optical sensor may be provided on the outside of the unit, to detect the home position by stopping the screen at the home position at predetermined number of pulses after passing the sensor. Further, the screen may be caused to stop at the home position by locking it by using a nib, and removing the lock at the time of rotation, so that the phase is determined based on the number of pulses applied after the removal of the lock.

In this embodiment, the toner residual amount is detected by the toner count recorded in the storage element, but a translucent window may be provided on a wall of the developing cartridge 12 to detect the toner residual amount in the developing cartridge 12 from this window by means of a photosensor or the like.

Moreover, in the color laser printer 10 of this embodiment, the four developing cartridges 12C, 12M, 12Y and 12K that are filled with four colors of toners, cyan, magenta, yellow and black, are attached to the rotary developing unit 14 (so-called "four cycle system"), but three or less developing cartridges may be attached or five or more developing cartridges may be attached as long as the rotary developing unit 14 has a rotatable mechanism.

Furthermore this embodiment describes the color laser printer 10 in which there are attached the developing cartridges 12 filled with a plurality of colors of toners as recording agents, but the color laser printer 10 may be a color copying machine in which a similar type of developing cartridge 40K is attached.

What is claimed is:

1. An image forming apparatus comprising:

a rotary developing unit, to and from which a plurality of developing cartridges storing developers are attached and detached and which moves one of the attached developing cartridges to a developing position by being rotated around a rotation axis;

a drive motor that rotates the rotary developing unit; and a controller that controls a torque of the drive motor in response to a condition of the developing cartridges to be attached to the rotary developing unit and/or a condition of the rotary developing unit, wherein the torque of the drive motor is determined based on an amount of current to be fed to the drive motor, and the controller controls the torque of the drive motor by controlling the amount of current to be fed to the drive motor in response to the condition of the developing cartridges and/or the condition of the rotary developing unit.

2. The image forming apparatus according to claim 1, wherein the condition of the developing cartridges to be attached to the rotary developing unit and/or the condition of the rotary developing unit includes at least any one of: an attachment condition indicating a number of the developing cartridges attached to the rotary developing unit and a place of attachment of the developing cartridges; a residual amount of the developers of the developing cartridges attached to the rotary developing unit; a phase indicating a position of rotation of the rotary developing unit; and a rotational acceleration of the rotary developing unit.

3. An image forming apparatus comprising:

a rotary developing unit, to and from which a plurality of developing cartridges storing developers are attached and detached and which moves one of the attached developing cartridges to a developing position by being rotated around a rotation axis;

a drive motor that rotates the rotary developing unit; and a controller that controls a torque of the drive motor in response to a condition of the developing cartridges to be attached to the rotary developing unit and/or a condition of the rotary developing unit, wherein the condition of the developing cartridges to be attached to the rotary developing unit and/or the condition of the rotary developing unit include all of: an attachment condition indicating a number of the developing cartridges attached to the rotary developing unit and a place of attachment of the developing cartridges; a residual amount of the developers of the developing cartridges attached to the rotary developing unit; a phase indicating a position of rotation of the rotary developing unit; and a rotational acceleration of the rotary developing unit.

4. The image forming apparatus according to claim 3, wherein the controller obtains a reference current amount on the basis of the attachment condition and the developer residual amount, obtains an adjustment factor on the basis of the phase, obtains a compensation factor on the basis of the rotational acceleration, calculates the amount of current by adding the compensation factor to a result obtained by multiplying the reference current amount by the adjustment factor, and controls the drive motor by means of the calculated current amount.

* * * * *